United States Patent [19]

Terry

[11] Patent Number: 4,583,493

[45] Date of Patent: Apr. 22, 1986

[54] ANIMAL TRAINING DEVICE

[76] Inventor: James D. Terry, 3248 S. St. Paul St., Wichita, Kans. 67217

[21] Appl. No.: 681,122

[22] Filed: Dec. 12, 1984

[51] Int. Cl.[4] ..... B68B 1/00

[52] U.S. Cl. ..... 119/130; 54/71

[58] Field of Search ..... 119/29, 130, 132; 54/71

[56] References Cited

U.S. PATENT DOCUMENTS

| | | | |
|---|---|---|---|
| 1,214,927 | 2/1917 | Knittel | 119/130 |
| 1,372,806 | 3/1921 | Freeman | 119/130 |
| 1,552,145 | 9/1925 | Haile | 54/6 |
| 2,252,894 | 8/1941 | Martin | 119/132 |
| 2,572,517 | 10/1951 | Ratliff | 54/6 |
| 2,623,340 | 12/1952 | Rudolph | 54/6 |
| 3,306,005 | 2/1967 | Stafford | 54/6 |
| 3,731,456 | 5/1973 | Hill | 54/24 |
| 4,459,795 | 7/1984 | Le Tixerant | 54/6 A |

*Primary Examiner*—Robert P. Swiatek

*Attorney, Agent, or Firm*—John E. Reilly

[57] ABSTRACT

Animal training device allowing a trainer to control an animal by exerting pressure on sensitive areas of the animal's head, the device including a harness assembly for securing the device to the head of an animal, a bosal assembly attached to the harness in a spaced relation to the snout of the animal, and a spring-loaded bridge piece resting in a centered position below the upper portion of the bosal on the snout of the animal. In operation, the bosal is snapped against the bridge piece, which serves to transmit pressure to sensitive areas on the animal's head while protecting these areas against injury.

9 Claims, 5 Drawing Figures

ANIMAL TRAINING DEVICE

SPECIFICATION

This invention relates to animal training devices and, more particularly, relates to a novel and improved training device adapted for use in combination with a harness to facilitate effective and expeditious training of horses and other animals.

BACKGROUND AND FIELD OF THE INVENTION

It has long been the practice when training horses to place a halter or harness over the head of the horse to aid in teaching the horse to obey commands. Early training devices often employed a bit, which was placed in the horse's mouth in order to effect control over the animal. Bitted bridles were found to be unsatisfactory training devices, however, because horses instinctively fought against the bit, thus causing injury to the horse's mouth.

Several patents have disclosed bitless harnesses which effect control over the horse by applying pressure to sensitive portions of the horse's head, such as, across the top of the head, behind the ears, across the front of the nose or under the chin. These devices typically employ bosals, cords or similar devices which are held in contact with the head and are caused to exert pressure on sensitive areas through a variety of mechanisms. One of the drawbacks of these prior art devices is that they often cause injury by digging into the soft portions of the horse's head.

SUMMARY OF THE INVENTION

It is, therefore, a primary object of the present invention to provide for a novel and improved animal training device which may be used for effective training of horses and other animals. While this invention is particularly useful in training horses, it also has significant utility in training other animals. References to horses in this disclosure are, therefore, intended for purposes of illustration and not limitation.

Another object of the present invention is to provide an animal training device which enables more effective training of animals by concentrating pressure on sensitive areas of the animal's head to discourage the animal from disobeying commands.

Another object of the present invention to provide for an animal training device which facilitates effective training of animals without causing injury to said animal.

It is a further object of the present invention to provide for an animal training device which may be constructed of lightweight materials suitable for use with small animals.

In accordance with the present invention, a novel and improved animal training device comprises a harness assembly for securing the device to the head of an animal in combination with an arcuate bosal assembly attached to the harness and disposed in spaced, surrounding relation to the snout of the animal. An arcuate bridge or nose piece, constructed of rigid or semi-rigid material, is spring-loaded downwardly from the bosal portion by fore and aft spaced spring members. Guides project outwardly from the ends of the bridge to retain it in a centered position beneath the upper portion of the bosal. In its normal relaxed or equilibrium position, the bridge piece rests on the nose of the animal while the bosal is isolated from the animal's muzzle by the spring members between the bosal and the bridge member. A rope for activating the device is attached to a ring located at the bottom of the bosal. Alternatively, the device may be activated by reins attached to opposite sides at the lower portion of the bosal. In operation, the spring-loaded bosal is snapped against the bridge member resting on the snout of the animal when the mechanism is activated by jerking the rope or reins in a downward direction. The movement of the bosal during operation is stabilized by a spring disposed between the lower portion of the bosal assembly and the lower portion of the harness. This spring further serves to maintain the bosal in the desired spaced relation to the animal's snout when the training device is not in use.

This device is more effective than the bosal alone in discouraging the animal from disobeying commands. Furthermore, because the bosal is normally isolated from the animal's snout, this device avoids injury to the animal which often results from the use of bosals that cut or dig into the soft portion of the ridge or bridge between the nostrils on the animal's snout. In addition, the snapping action of the bridge has been found to produce more rapid and consistent response by the animal to different commands.

The above and other objects, advantages and features of the present invention will become more readily understood and appreciated from a consideration of the following detailed description of a preferred embodiment of the present invention when taken together with the accompanying drawings in which:

DETAILED DESCRIPTION OF THE PREFERRED EMBODIMENT

Figure 1:
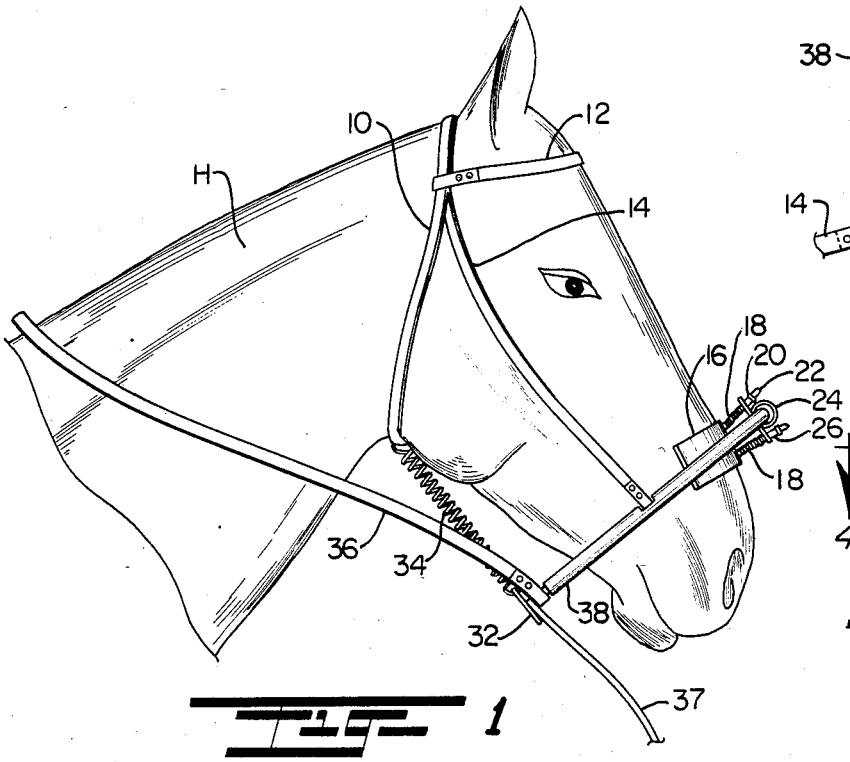
FIG. 1 is a side view of the preferred embodiment of the animal training device fitted to the head of a horse.

Referring now to the accompanying drawings in more detail, there is shown an animal training device embodying the present invention. In FIG. 1, the training device is shown mounted on the head of a horse H. A conventional type of harness assembly includes a neck loop 10 comprising an elongated strip of leather or other flexible material, with opposite ends of said strip joined together to cause the loop to fit snugly around the animal's neck. The neck loop 10 is retained in the desired position by a head strap 12 looped around the upper portion of the animal's head and having its ends connected to opposite sides of the upper portion of the neck loop 10.

Figure 2:
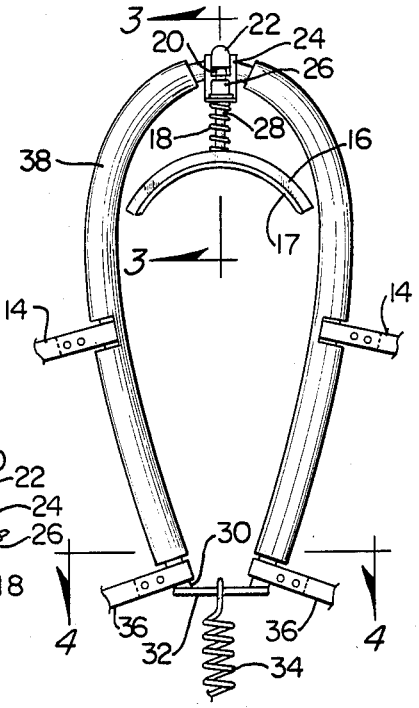
FIG. 2 is a front view of the preferred form of the bosal assembly.
Figure 4:
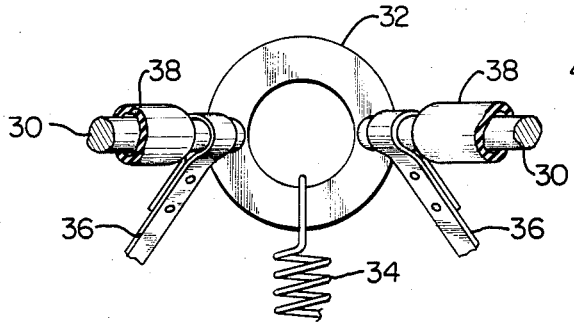
FIG. 4 is a fragmentary detailed top view partly in section taken along lines 4—4 of FIG. 2 showing the lower section of the bosal assembly.

FIG. 2 shows an arcuate bosal 30 which is formed from an inverted U-shaped rod and is disposed over the snout of the animal. The bosal 30 is attached to the harness assembly by means of nose straps 14, as shown in FIG. 1, extending along either side of the animal's head from the point of intersection of the neck strap 10 with the head strap 12 to points along opposite sides of the bosal 30. The bosal 30 is covered with a coating of rubber or rubber-like material 38, as shown in FIG. 4. The ends of the U-shaped rod are each attached to opposite sides of a ring 32, thus closing the bosal. The bosal is maintained in the desired position on the animal's snout by a coiled spring member 34 disposed between the ring 32 and the lower portion of the neck loop 10.

Figure 3:
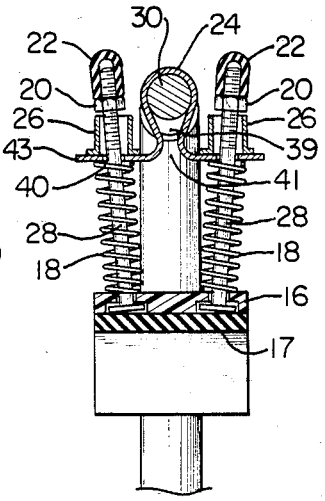
FIG. 3 is a fragmentary detailed side view partly in section taken along lines 3—3 of FIG. 2 showing the means for mounting the bridge piece to the bosal.

A substantially arcuate bridge member 16 is interposed between the bosal 30 and the snout of the animal. The bridge member 16 has a layer of rubber or rubber-like material 17 suitable for engaging the snout of the animal. As shown in FIG. 3, the bridge member is retained in a centered position beneath the bosal 30 by a bracket 24 attached to the bosal 30. The bracket 24 is in the form of a generally omega-shaped spring clip with a central opening 39 having a narrowed entrance 41 for press-fit insertion of the bosal 30 into the opening 39 and relatively flat arms 43 extending away from the opposite sides of the narrowed entrance 41. The plates have fore and aft apertures 40 and the apertures 40 are provided with aligned sleeves 26 to permit insertion of guide rods 28. The ends of the guide rods 28 opposite the bridge member 16 are threaded in order to receive retaining nuts 20. Protective caps 22 are placed over the portion of the threaded rod extending upward beyond the retaining nuts. Spring members 18 disposed between the bosal 30 and the bridge member 16 are mounted under compression on the guide rods 28 to yieldingly urge the bridge member 16 against the snout of the animal while isolating the bosal 30 from direct contact with the snout. The compression of the spring members 18 may be adjusted by varying the location of the retaining nuts 20 on the guide rods 28.

Figure 5:
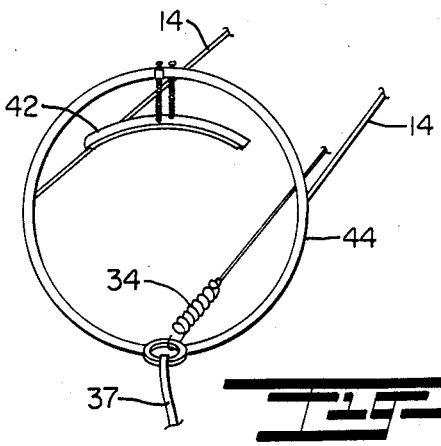
FIG. 5 is a perspective view of an alternative embodiment of the animal training device adaptable for use with a dog or other small animal.

FIG. 5 shows an alternative embodiment of the present invention adapted for use with dogs or other small animals. The bosal 44 and bridge member 42 shown in this embodiment are constructed of plastic or other semi-rigid, lightweight material.

The trainer operates the device by causing the bosal 30 rapidly to come into contact with the bridge member 16, thus translating the momentum of the bosal 30 into a force transmitted through the bridge member 16 to sensitive areas on the animal's snout. A force may be exerted on the bosal by means, such as, a rein 36 attached to opposite ends of the lower portion of the bosal 30 or a rope 37 attached to the ring 32.

It is, therefore, to be understood that various modifications and changes may be made in the precise construction and arrangement of elements comprising the preferred form of the present invention without departing from the spirit and scope thereof as defined by the appended claims.

I claim:

1. An animal training device, comprising:

a. a harness having a generally circular element adapted to extend around a horse's neck and to rest on the nape of said horse's neck with an upper portion of said circular element resting generally proximate to and behind said horse's ears, a tie element having opposite ends with each end being attached to the upper portion of said circular element and with said tie element being adapted to extend over said horse's head in a plane generally perpendicular to the plane of said circular element;

b. a bosal adapted to fit over the snout of a horse, said bosal comprising a generally U-shaped, rubber-coated rod including a ring attached to each end of said rod, said U-shaped rod being inverted with said ring disposed underneath the chin of a horse;

c. a spring member disposed between said ring and a lower portion of the circular element;

d. a rope attached to said ring;

e. a bracket comprising a generally omega-shaped spring clip with a central opening having a narrowed entrance for press-fit insertion of said bosal and relatively flat arms extending away from opposite sides of the restricted opening, each of said arms having a sleeve positioned thereon;

f. an arcuate bridge member adapted for engaging the snout of a horse, said bridge member having rods affixed thereto in spaced relation to one another and inserted through said sleeves in said bracket;

g. at least two helical spring members, each disposed in surrounding relation to one of said guide rods, said spring members being disposed between said bridge member and said bracket to yieldingly urge said bridge member in a direction away from said bosal; and h. adjustable retaining means for adjusting the compression of said helical spring members.

2. An animal training device according to claim 1, said bosal comprising a generally circular strip of lightweight plastic or plastic-like material.

3. An animal training device according to claim 1, having two reins attached to opposite sides of the lower portion of the bosal.

4. In an animal training device having a harness assembly for securing said device to the head of an animal and a bosal member attached to said harness assembly having an upper portion disposed in spaced surrounding relation to the snout of the animal, the improvement comprising:

an arcuate bridge member interposed between said bosal member and the snout of the animal, said bridge member traversing only the upper portion of said bosal member, support means including at least one spring-loaded guide rod affixed to said bridge member and extending upwardly from said bridge member for mounting said bridge member in spaced relation to said bosal member with said bridge member disposed beneath said upper portion of said bosal member and resting against the snout of the animal, and means secured to said bosal member for applying a downwardly directed force to said bosal member causing said bosal member to be compressed downwardly toward said bridge member against the urging of said spring-loaded guide rod whereby said bridge member will exert pressure against the snout of the animal.

5. In an animal training device according to claim 4, said bridge member being a rigid member traversing said upper portion of said snout.

6. In an animal training device according to claim 5, said bridge member having a layer of rubber or rubber-like material adapted to engage the snout of an animal.

7. In an animal training device according to claim 4, said support means comprising a bracket receiving said upper portion of said bosal.

8. In an animal training device according to claim 7, said bracket being defined by a generally omega-shaped spring clip with a central opening having a narrowed entrance for press-fit insertion of said bosal and relatively flat arms extending away from opposite sides of the restricted opening, with said arms having apertures and being provided with aligned sleeves for receiving a pair of said spring-loaded guide rods through said apertures.

9. In an animal training device according to claim 8, said support means being resilient.

* * * * *